United States Patent [19]

Mori et al.

[11] Patent Number: 5,043,313

[45] Date of Patent: Aug. 27, 1991

[54] THERMOSENSITIVE RECORDING MATERIAL

[75] Inventors: Yasutomo Mori, Numazu; Norio Kurisu, Susono; Toshinobu Iwata, Oyama; Mikio Goto, Numazu, all of Japan

[73] Assignee: Ricoh Company, Ltd., Tokyo, Japan

[21] Appl. No.: 497,968

[22] Filed: Mar. 23, 1990

[30] Foreign Application Priority Data

Apr. 3, 1989 [JP] Japan ..... 1-81601

[51] Int. Cl.[5] ..... B41M 5/32

[52] U.S. Cl. ..... 503/210; 427/150; 427/151; 503/200; 503/211; 503/212; 503/216; 503/217; 503/225; 503/226

[58] Field of Search ..... 427/150-152; 503/200, 210-212, 216-218, 225, 226

[56] References Cited

U.S. PATENT DOCUMENTS 4,536,779 8/1985 Nachbur et al. ..... 503/212

4,729,984 3/1988 Hama et al. ..... 503/216

*Primary Examiner*—Bruce H. Hess

*Attorney, Agent, or Firm*—Oblon, Spivak, McClelland, Maier & Neustadt

[57] ABSTRACT

A thermosensitive recording material comprising (a) a support, and (b) a thermosensitive recording layer formed on the support, comprising a leuco dye and a color developing agent comprising a metal salt or metal complex of a compound having formula (I), which is capable of inducing color formation in the leuco dye upon application of heat thereto:

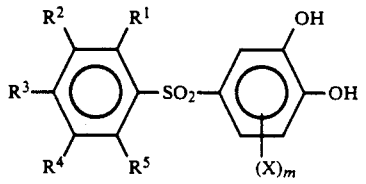

(I)

wherein X represents a halogen, an alkyl group having 1 to 10 carbon atoms, or an alkoxyl group having 1 to 10 carbon atoms; $R^1$, $R^2$, $R^3$, $R^4$ and $R^5$ independently represent hydrogen, a halogen, a hydroxyl group, an alkyl group having 1 to 10 carbon atoms, an alkoxyl group having 1 to 10 carbon atoms, an aralkyloxyl group having 7 to 20 carbon atoms, an aryloxyl group having 6 to 20 carbon atoms, an alkylthio group having 1 to 10 carbon atoms, an aralkylthio group having 6 to 20 carbon atoms or an arylthio group having 6 to 20 carbon atoms, $R^1$ and $R^2$, or $R^2$ and $R^3$ may form together with an adjacent benzene ring a naphthalene ring, a tetrahydronaphthalene ring or an indan ring; and m is an integer of 1 to 4.

20 Claims, No Drawings

THERMOSENSITIVE RECORDING MATERIAL

BACKGROUND OF THE INVENTION

1. Field of the Invention

This invention relates to a thermosensitive recording material comprising a leuco dye and a specific color developing agent, capable of producing color images with high reliability when heat is applied thereto.

2. Discussion of Background

Thermosensitive recording materials are, in general, composed of a substrate such as a sheet of paper or synthetic paper, or a resinous film, and a thermosensitive coloring layer formed thereon, which develops color when heat is applied thereto. For the application of heat to the coloring layer, a thermal printer with a built-in thermal head is usually employed.

The recording method using the above thermosensitive recording material is advantageous over the recording methods of other types in that it requires neither an image developing process nor an image fixing process, so that images can be recorded by using a relatively simple device in a short time. Since the thermosensitive recording materials can be produced inexpensively, the thermosensitive recording method is also economically advatageous. For the above and other advantages, the thermosensitive recording method is applied to various objects such as copying apparatus, facsimiles, ticket-vending apparatus, label printers, and recorders.

However, no perfect thermosensitive recording materials are known so far. For instance, some of the recording materials yield a so-called "head-dust" which sticks to the thermal head. The head-dust gives rise to sticking phenomenon, and also brings about abrasion of thermal head. The clearness of the recorded images is thus degraded.

Moreover, it is now greatly demanded to enhance the resistance to water and oil to improve the reliability of images recorded on tickets and labels.

In order to improve the reliability of recorded images, various studies have been made on each of the component layers of the thermosensitive recording material such as a thermosensitive coloring layer, an undercoat layer and an overcoat layer; and various color developing agents have also been proposed, for example, diphenylthioacetic ester derivatives as disclosed in Japanese Laid-Open Patent Application 62-271789, bis(4-hydroxyphenyl)acetic alkyl ester derivatives as disclosed in Japanese Laid-Open Patent Application 62-273885, carboxybenzamide compounds as disclosed in Japanese Laid-Open Patent Application 62-282972, p-toluene sulfonylhydrazide as disclosed in Japanese Laid-Open Patent Application 62-294590, 2,4'-dihydroxydiphenylsulfone as disclosed in Japanese Laid-Open Patent Application 63-3991, salicylic acid derivatives as disclosed in Japanese Laid-Open Patent Applications 63-22682, 63-22683, 63-28691 and 63-30283, pulenyltetramethylene sulfonium hexafluorophosphate as disclosed in Japanese Laid-Open Patent Application 63-45087, 2,4-bis(4β-p-hydroxybenzoyloxycarbonyl)benzene as disclosed in Japanese Laid-Open Patent Application 63-72590, 3-aryl-4-hydroxyphenylsulfone as disclosed in Japanese Laid-Open Patent Application 63-77779, 3-allyl-4-hydroxy-4'-methyldiphenylsulfone as disclosed in Japanese Laid-Open Patent Application 63-82778, carboxylates having two hydroxyphenyl groups as disclosed in Japanese Laid-Open Patent Application 63-84979, substituted benzyl fumarates as disclosed in Japanese Laid-Open Patent Application 63-102981, bis(substituted-hydroxyphenyl)acetate derivatives as disclosed in Japanese Laid-Open Patent Application 63-128985, and β-p-methoxyphenoxy-ethyltolyloxy acetate as disclosed in Japanese Laid-Open Patent Application 63-132084.

Aside from the above proposals, attempts have been made, in which a specific auxiliary component is incorporated into a thermosensitive coloring layer or an undercoat layer, to improve the reliability of recorded images. For example, alkaline salts of an organic carboxylic acid or its anhydride are incorporated into a thermosensitive coloring layer as disclosed in Japanese Laid-Open Patent Application 58-11193, metal salts of salicylaldoxime are incorporated into a thermosensitive coloring layer as disclosed in Japanese Laid-Open Patent Application 58-140291, zinc chloride and/or magnesium chloride is incorporated into an undercoat layer as disclosed in Japanese Laid-Open Patent Application 59-115892, a diphenyl ether compound having a formula of $(X)_m$-Ph-O- Ph-$(X)_n$ is incorporated into a thermosensitive coloring layer as disclosed in Japanese Laid-Open Patent Application 59-214689, zinc salts of an acrylic acid or α-acrylic acid are incorporated into a thermosensitive coloring layer as disclosed in Japanese Laid-Open Patent Application 60-34891, and bisphenol-S bis-substituted acetylester is incorporated into a thermosensitive coloring layer as disclosed in Japanese Laid-Open Patent Application 62-294589.

As described above, many proposals have been made until now, but none of them can fully attain the aimed object, that is, the improvement of reliability of recorded images.

SUMMARY OF THE INVENTION

Accordingly, an object of the present invention is to provide a thermosensitive recording material which can overcome the drawbacks in the prior art and can produce images with high reliability, more specifically, images having high resistance to oil, plasticizer, water and heat.

The object of the invention can be attained by a thermosensitive recording material comprising (a) a support, and (b) a thermosensitive recording layer formed on the support, comprising a leuco dye and a color developing agent comprising a metal salt or metal complex of a compound having formula (I), which is capable of inducing color formation in the leuco dye upon application of heat thereto:

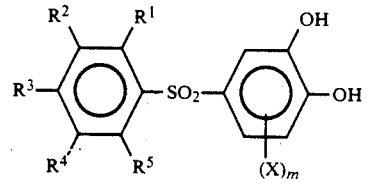

(I)

wherein X represents a halogen, an alkyl group having 1 to 10 carbon atoms, or an alkoxyl group having 1 to 10 carbon atoms; $R^1$, $R^2$, $R^3$, $R^4$ and $R^5$ independently represent hydrogen, a halogen, a hydroxyl group, an alkyl group having 1 to 10 carbon atoms, an alkoxyl group having 1 to 10 carbon atoms, an aralkyloxyl group having 7 to 20 carbon atoms, an aryloxyl group having 6 to 20 carbon atoms, an alkylthio group having 1 to 10 carbon atoms, an aralkylthio group having 6 to 20 carbon atoms or an arylthio group having 6 to 20 carbon atoms, $R^1$ and $R^2$, or $R^2$ and $R^3$ may form together with an adjacent benzene ring a naphthalene ring, a tetrahydronaphthalene ring or an indan ring; and m is an integer of 1 to 4.

DETAILED DESCRIPTION OF THE PREFERRED EMBODIMENTS

The thermosensitive recording material according to the present invention comprises, in its thermosensitive recording layer, a leuco dye, and a color developing agent comprising a metal salt or a metal complex of a compound having the above-described formula (I).

In formula (I), X represents a halogen, an alkyl group having 1 to 10 carbon atoms, or an alkoxyl group having 1 to 10 carbon atoms. Of these, a halogen, an alkyl group having 1 to 6 carbon atoms, and an alkoxyl group having 1 to 6 carbon atoms are preferred.

$R^1$, $R^2$, $R^3$, $R^4$ and $R^5$ in formula (I) independently represent hydrogen, a halogen, a hydroxyl group, an alkyl group having 1 to 10 carbon atoms, an alkoxyl group having 1 to 10 carbon atoms, an aralkyloxyl group having 7 to 20 carbon atoms, an aryloxyl group having 6 to 20 carbon atoms, an alkylthio group having 1 to 10 carbon atoms, an aralkylthio group having 6 to 20 carbon atoms or an arylthio group having 6 to 20 carbon atoms. Of these, hydrogen, a halogen, a hydroxyl group, an alkyl group having 1 to 6 carbon atoms, an alkoxyl group having 1 to 6 carbon atoms, an aralkyloxyl group having 7 to 10 carbon atoms, an aryloxyl group having 6 to 10 carbon atoms, an alkylthio group having 1 to 6 carbon atoms, an aralkylthio group having 7 to 10 carbon atoms, and an arylthio group having 6 to 10 carbon atoms are preferred.

The following are specific examples of the compound having formula (I):

3,4-dihydroxydiphenylsulfone,
3,4-dihydroxy-4'-methyldiphenylsulfone,
3,4-dihydroxy-4'-ethyldiphenylsulfone,
3,4-dihydroxy-4'-propyldiphenylsulfone,
3,4-dihydroxy-4'-isopropyldiphenylsulfone,
3,4-dihydroxy-4'-butyldiphenylsulfone,
3,4-dihydroxy-2,4'-dimethyldiphenylsulfone,
3,4-dihydroxy-4'-chlorodiphenylsulfone,
3,4,4'-trihydroxydiphenylsulfone,
3,4-dihydroxy-4'-cyclohexyldiphenylsulfone,
3,4-dihydroxy-4'-methoxydiphenylsulfone,
3,4-dihydroxy-4'-ethoxydiphenylsulfone,
3,4-dihydroxy-4'-phenoxydiphenylsulfone,
3,4-dihydroxy-4'-benzyloxydiphenylsulfone,
3,4-dihydroxy-4'-benzyldiphenylsulfone,
3,4-dihydroxy-4'-phenethyldiphenylsulfone,
3,4-dihydroxy-4'-methylthiodiphenylsulfone,
3,4-dihydroxy-4'-ethylthiodiphenylsulfone,
3,4-dihydroxy-4'-phenylthiodiphenylsulfone,
3,4-dihydroxy-4'-benzylthiodiphenylsulfone,
3,4-dihydroxyphenyl-1-naphthylsulfone,
3,4-dihydroxyphenyl-2-naphthylsulfone,
3,4-dihydroxy-2',3',5'-trimethyldiphenylsulfone, and
3,4-dihydroxy-2',3',5',6'-tetramethyldiphenylsulfone.

A metal of the metal salt or metal complex of the compound having formula (I) for use in the present invention as a color developing agent is selected from the group consisting of Mg, Ca, Cu, Zn, Fe, Al, Sn and Ba. Of these, Mg, Ca, Cu, Zn, Al and Sn are preferable, and Zn and Al are more preferable.

For example, an aluminum salt of the compound having formula (I) can be synthesized in accordance with the following reaction scheme.

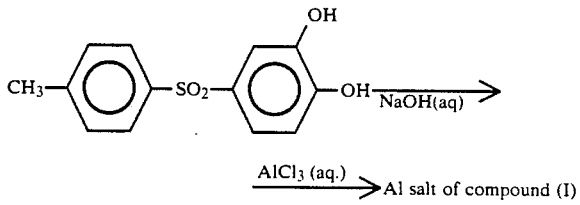

Namely, 3,4-dihydroxy-4'-methyldiphenylsulfone is first dissolved in an aqueous solution of sodium hydroxide. An aqueous aluminum chloride solution is then added dropwise to the above-prepared solution to initiate the reaction. When the reaction is completed, the reaction mixture liberates an aluminum salt of 3,4-dihydroxy-4'-methyldiphenylsulfone as a precipitate. The precipitate is collected by filtration, and is purified to obtain the aimed compound.

Any leuco dyes ordinarily used in conventional thermosensitive recording materials can be employed in the present invention. For example, triphenylmethane-type leuco dyes, fluoran-type leuco dyes, phenothiazine-type leuco dyes, Auramine-type leuco dyes, spiropyrane-type leuco dyes and indolinophthalide-type leuco dyes are preferably employed in the present invention either singly or in combination.

Specific examples of the leuco dyes usable in the present invention are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthyl-lactam benzoate],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-isoamylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran, benzoyl leuco Methylene Blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran, and
3-diethylamino-6-methyl-7-mesidino-4',5'-benzofluoran.

Any conventional color developing agents can be used along with the metal salt or complex of the compound (I), serving as an additional color developing agent, so far as they do not impair the effects of the present invention. Among the conventional color developing agents, various electron acceptor type compounds such as phenol compounds, thiophenol compounds, thiourea derivatives, organic acids and metal salts thereof are preferably employed. Specific examples of such compounds are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
4,4'-thiobis(6-tert-butyl-2-methyl)phenol,
4,4'-diphenolsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis4-hydroxyphenylthio)-2-hydroxypropane,
N,N'-diphenylthiourea,
N,N'-di(m-chlorophenyl)thiourea,
salicylanilide,
5-chloro-salicylanilide,
salicyl-o-chloroanilide,
2-hydroxy-3-naphthoic acid,
2-hydroxy-1-naphthoic acid,
1-hydroxy-2-naphthoic acid,
zinc salt of hydroxynaphthoic acid,
aluminum salt of hydroxynaphthoic acid, and
calcium salt of hydroxynaphthoic acid.

Furthermore, various thermofusible materials may be used to improve thermal sensitivity, if necessary. Specific examples of such thermofusible materials are as follows: fatty acids such as stearic acid and behenic acid, fatty acid amides such as stearic acid amide and palmitic acid amide, metal salts of fatty acid such as zinc stearate, aluminum stearate, calcium stearate, zinc palmitate and zinc behenate, p-benzylphenyl methane, p-benzylterphenyl methane, p-benzyltriphenyl methane, p-benzyloxybenzyl benzoate, β-benzyloxynaphthalene, β-naphthoic acid, β-naphthoic phenyl ester, 1-hydroxy-2-naphthoic acid phenyl ester, 1-hydroxy-2-naphthoic acid methyl ester, diphenyl carbonate, terephthalic acid dimethyl ester, 1,4-dimethoxynaphthalene, 1,4-diethoxynaphthalene, 1,4-dibenzyloxynapthalene, 1,2-bis-(phenoxy)ethane, 1,2-bis(3-methylphenoxy)ethane, 1,2-bis-(4-methylphenoxy)ethane, 1,4-bis(-phenoxy)butane, 1,4-bis-(phenoxy)-2-butene, 1,2-bis(4-methoxyphenylthio)ethane, dibenzoylmethane, 1,4-bis(-phenylthio)butane, 1,4-bis(phenylthio)-2-butene, 1,2-bis(4-methoxyphenylthio)ethane, 1,3-bis-(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibenzyldisulfide, 1,1-diphenylethanol, 1,1-diphenylpropanol, p-(benzyloxy)benzylalcohol, 1,3-diphenoxy-2-propanol, N-octadecylcarbamoyl-p-methoxycarbonyl benzene, N-octadecylcarbamoyl benzene and dibenzyloxalate derivatives.

Any conventional binder agents can be used in the thermosensitive recording layer. Specific examples of the binder agents include polyvinyl alcohol, starch and derivatives thereof, cellulose derivatives such as methoxy cellulose, hydroxyethyl cellulose, carboxymethyl cellulose, methyl cellulose and ethyl cellulose, water-soluble polymers such as sodium polyacrylate, polyvinylprrolidone, a copolymer of acrylic acid amide and acrylate, a terpolymer of acrylic acid amide, acrylate and methacrylate, alkaline salts of a copolymer of styrene and maleic anhydride, alkaline salts of a copolymer of isobutylene and maleic anhydride, polyacryl amide, sodium alginate, gelatine and casein, and latexes of polyvinylacetate, polyurethane, a copolymer of sytrene and butadiene, polyacrylic acid, polyacrylate, a copolymer of vinylchloride and vinylacetate, polybutylmethacrylate, a copolymer of ethylene and vinylacetate and a terpolymer of styrene, butadiene and acrylic acid.

The amount of the binder agent is approximately 10 to 40 wt. % of the total weight of the thermosensitive recording layer of the present invention.

Auxiliary components such as filler, a surface active agent, a thermofusible material and a lubricant, which are conventionally incorporated into thermosensitive recording materials, may be used in the present invention, if necessary.

Examples of the filler include inorganic fine powder such as calcium carbonate, silica, zinc oxide, titanium oxide, aluminum hydroxide, zinc hydroxide, barium sulfate, clay, talc and surface-treated calcium or silica, and organic fine powder such as of a urea-formalin resin, a copolymer of styrene and methacrylic acid and a polystyrene resin.

The metal salt or metal complex of the compound having formula (I) which serves as a color developing agent is incorporated into a thermosensitive recording layer. Furthermore, when the thermosensitive recording layer comprises a thermosensitive coloring layer in which the leuco dye is contained and an undercoat layer and/or an overcoat layer, the metal salt or metal complex of the compound (I) can be incorporated into at least one of these layers.

When the metal salt or metal complex of the compound (I) is incorporated into a thermosensitive recording or coloring layer of the recording material, its incorporation amount is 0.1 to 10 parts by weight, preferably 1.0 to 5.0 parts by weight, per one part by weight of the leuco dye contained in the thermosensitive recording or coloring layer.

On the other hand, when it is incorporated into an undercoat layer and/or an overcoat layer, its incorporation amount in each layer is 0.1 to 5.0 parts by weight, preferably 0.1 to 1.0 part by weight, per one part by weight of the leuco dye contained in the thermosensitive coloring layer. In this case, a conventional color developing agent is contained in the thermosensitive coloring layer, so that the metal salt or complex of the compound (I) of the present invention serves as a subsidiary color developing agent.

In the present invention, a protective layer, and a backcoat layer may also be provided, if necessary.

Other features of this invention will become apparent in the course of the following description of exemplary embodiments, which are given for illustration of the invention and are not intended to be limiting thereof.

EXAMPLE 1

[I] Preparation of Liquid for Formation of Thermosensitive Coloring Layer (1) Preparation of Dye Dispersion The following components were placed in a sand mill pot, and were dispersed for 24 hours to obtain a dye dispersion.

| | Parts by Weight |
|---|---|
| 3-Dibutylamino-6-methyl-7-anylinofluoran | 20 |
| 10% Aqueous polyvinyl alcohol solution | 20 |
| Water | 60 |

(2) Preparation of Dispersion of Color Developing Agent

The following components were placed in a sand mill pot, and were dispersed for 24 hours to obtain Dispersion A of a color developing agent.

| <Dispersion A> | Parts by Weight |
|---|---|
| Aluminum salt of 3,4-dihydroxy-4'-methyldiphenylsulfone | 60 |
| Calcium carbonate | 40 |
| 10% Aqueous polyvinyl alcohol solution | 60 |
| Water | 140 |

A liquid for forming a thermosensitive coloring layer was prepared by blending 10 parts by weight of the above-prepared dye dispersion and 30 parts by weight of Dispersion A of a color developing agent.

[II] Preparation of Liquid for Formation of Overcoat Layer

The following components were thoroughly mixed to obtain a liquid for forming an overcoat layer.

| | Parts by Weight |
|---|---|
| 10% Aqueous polyvinyl alcohol solution | 30 |
| Thermoset organic filler | 1.2 |
| Water-resistance-imparting agent (10% aqueous solution) | 10 |
| Water | 8.8 |

[III] Preparation of Thermosensitive Recording Material

The liquid for forming a thermosensitive coloring layer prepared in the above [I] was coated onto a sheet of commercially available high quality paper in a deposition amount of 6.3 g/m$^2$ (dry basis), and then dried to form a thermosensitive coloring layer.

Onto this layer, the liquid for forming an overcoat layer prepared in the above [II]was coated in a deposition amount of 2 g/m$^2$ (dry basis), and then dried, followed by subjecting to supercalendering, whereby thermosensitive recording material No. 1 according to the present invention was prepared.

EXAMPLE 2

The procedure in Example 1 was repeated except that the Dispersion A employed in Example 1 was replaced by Dispersion B having the following formulation, whereby thermosensitive recording material No. 2 according to the present invention was prepared.

| <Dispersion B> | Parts by Weight |
|---|---|
| Zinc salt of 3,4-dihydroxy-4'-methyldiphenylsulfone | 60 |
| Calcium carbonate | 40 |
| 10% Aqueous polyvinyl alcohol solution | 60 |
| Water | 140 |

EXAMPLE 3

The procedure in Example 1 was repeated except that the Dispersion A employed in Example 1 was replaced by Dispersion C having the following formulation, whereby thermosensitive recording material No. 3 according to the present invention was prepared.

| <Dispersion C> | Parts by Weight |
|---|---|
| Aluminum salt of 3,4-dihydroxy-4'-chlorodiphenylsulfone | 60 |
| Calcium carbonate | 40 |
| 10% Aqueous polyvinyl alcohol solution | 60 |
| Water | 140 |

EXAMPLE 4

The procedure in Example 1 was repeated except that the Dispersion A employed in Example 1 was replaced by Dispersion D having the following formulation, whereby thermosensitive recording material No. 4 according to the present invention was prepared.

| <Dispersion D> | Parts by Weight |
|---|---|
| Aluminum salt of 3,4-dihydroxy-4'-phenoxydiphenylsulfone | 60 |
| Calcium carbonate | 40 |
| 10% Aqueous polyvinyl alcohol solution | 60 |
| Water | 140 |

EXAMPLE 5

The procedure in Example 1 was repeated except that the Dispersion A employed in Example 1 was replaced by Dispersion E having the following formulation, whereby thermosensitive recording material No. 5 according to the present invention was prepared.

| <Dispersion E> | Parts by Weight |
|---|---|
| Magnesium salt of 3,4-dihydroxy-4'-phenoxydiphenylsulfone | 60 |
| Calcium carbonate | 40 |
| 10% Aqueous polyvinyl alcohol solution | 60 |
| Water | 140 |

EXAMPLE 6

The procedure in Example 1 was repeated except that the Dispersion A employed in Example 1 was replaced by Dispersion F having the following formulation, whereby thermosensitive recording material No. 6 according to the present invention was prepared.

| <Dispersion F> | Parts by Weight |
|---|---|
| 1,7-Bis(4-hydroxyphenylthio)-3,5-oxaheptane | 60 |
| Aluminum salt of 3,4-dihydroxy-4'-methyldiphenylsulfone | 20 |
| Calcium carbonate | 40 |
| 10% Aqueous polyvinyl alcohol solution | 60 |
| Water | 120 |

EXAMPLE 7

The procedure in Example 1 was repeated except that the Dispersion A employed in Example 1 was replaced by Dispersion G having the following formulation, whereby thermosensitive recording material No. 7 according to the present invention was prepared.

| <Dispersion G> | Parts by Weight |
|---|---|
| 1,7-Bis(4-hydroxyphenylthio)-3,5-oxaheptane | 60 |
| Aluminum salt of 3,4-dihydroxy-4'-phenoxydiphenylsulfone | 20 |

-continued

| <Dispersion G> | Parts by Weight |
|---|---|
| Calcium carbonate | 40 |
| 10% Aqueous polyvinyl alcohol solution | 60 |
| Water | 120 |

EXAMPLE 8

A liquid for forming a thermosensitive coloring layer was prepared in the same manner as in Example 1 by using Dispersion H having the following formulation instead of the Dispersion A employed in Example 1.

| <Dispersion H> | Parts by Weight |
|---|---|
| 1,7-Bis(4-hydroxyphenylthio)-3,5-oxaheptane | 60 |
| Calcium carbonate | 40 |
| 10% Aqueous polyvinyl alcohol solution | 60 |
| Water | 140 |

The following components were thoroughly mixed to obtain Liquid L for forming an undercoat layer.

| <Liquid L> | Parts by Weight |
|---|---|
| Copolymer of styrene and methacrylic acid | 10 |
| Zinc salt of 3,4-dihydroxyphenyl-4'-methyldiphenylsulfone | 10 |
| 30% Aqueous solution of polyamide epichlorohydrin resin | 2 |
| 10% Aqueous polyvinyl alcohol solution | 10 |
| Water | 68 |

The above-prepared Liquid L was coated onto a sheet of commercially available high quality paper in a deposition amount of 2 g/m$^2$ (dry basis), and then dried to form an undercoat layer.

Onto this undercoat layer, the previously prepared liquid for forming a thermosensitive coloring layer was coated in a deposition amount of 6.3 g/m$^2$ (dry basis), and then dried to form a thermosensitive coloring layer.

The liquid for forming an overcoat layer prepared in Example 1 was coated onto the thermosensitive coloring layer in a deposition amount of 2 g/m$^2$ (dry basis), and then dried, followed by subjecting to supercalendering, whereby thermosensitive recording material No. 8 according to the present invention was prepared.

COMPARATIVE EXAMPLE 1

The procedure in Example 1 was repeated except that the Dispersion A employed in Example 1 was replaced by the Dispersion H employed in Example 8, whereby comparative thermosensitive recording material No. 1 was prepared.

COMPARATIVE EXAMPLE 2

The procedure in Example 1 was repeated except that the Dispersion A employed in Example 1 was replaced by Dispersion I having the following formulation, whereby comparative thermosensitive recording material No. 2 was prepared.

| <Dispersion I> | Parts by Weight |
|---|---|
| 3,4-Dihydroxy-4'-methyldiphenyl-sulfone | 60 |
| Calcium carbonate | 40 |
| 10% Aqueous polyvinyl alcohol solution | 60 |
| Water | 140 |

COMPARATIVE EXAMPLE 3

The procedure in Example 1 was repeated except that the Dispersion A employed in Example 1 was replaced by Dispersion J having the following formulation, whereby comparative thermosensitive recording material No. 3 was prepared.

| <Dispersion J> | Parts by Weight |
|---|---|
| 3,4-Dihydroxy-4'-phenoxydiphenyl-sulfone | 60 |
| Calcium carbonate | 40 |
| 10% Aqueous polyvinyl alcohol solution | 60 |
| Water | 140 |

COMPARATIVE EXAMPLE 4

The procedure in Example 1 was repeated except that the Dispersion A employed in Example 1 was replaced by Dispersion K having the following formulation, whereby comparative thermosensitive recording material No. 4 was prepared.

| <Dispersion K> | Parts by Weight |
|---|---|
| 1,7-Bis(4-hydroxyphenylthio)-3,5-oxaheptane | 60 |
| 1,1,3-Tris(2-methyl-4-hydroxy-5-cyclohexylphenyl)butane | 20 |
| Calcium carbonate | 40 |
| 10% Aqueous polyvinyl alcohol solution | 60 |
| Water | 120 |

COMPARATIVE EXAMPLE 5

The procedure of Example 8 was repeated except that the Liquid L used in Example 8 for forming the undercoat layer was replaced by Liquid M having the following formulation, whereby comparative thermosensitive recording material No. 5 was prepared.

| <Liquid M> | Parts by Weight |
|---|---|
| Copolymer of styrene and methacylic acid | 10 |
| 1,1,1-Tris(2-methyl-4-hydroxy-5-cyclohexylphenyl)butane | 10 |
| Polyamide epichlorohydrin resin | 2 |
| 10% Aqueous polyvinyl alcohol solution | 10 |
| Water | 68 |

The above-prepared thermosensitive recording materials Nos. 1 to 8 according to the present invention and comparative thermosensitive recording materials Nos. 1 to 5 were subjected to the following tests. The results are shown in Table 1.

i) Preparation of Samples to be Tested

Images were recorded on a receptor paper with a size of 6 cm×6 cm from each of the thermosensitive recording materials using a thermal block under the following conditions:

Temperature of thermal block: 200° C.

Weight of thermal block: 2 kg

Heating time: 2 seconds

The density of the recorded area and that of background of each sample thus obtained were measured by a McBeth densitometer RD-914.

(ii) Test for Evaluation of Oil Resistance

Cotton seed oil was applied to the surface of each of the above-prepared samples, and the resulting samples were preserved at 40° C. for 16 hours in a dry atmosphere. Thereafter, the density of the recorded area on each sample was measured by a McBeth densitometer RD-914.

(iii) Test for Evaluation of Plasticizer Resistance

The samples were covered by three sheets of "Polymawrap" (Trademark, made by Shin-Etsu Polymer Co., Ltd.), and then weighted 5 kg at 40° C. for 16 hours in a dry atmosphere. Thereafter, the density of the recorded area on each sample was measured by a McBeth densitometer RD-914.

(iv) Test for Evaluation of Water Resistance

The samples were placed in 100 ml of water, and allowed to stand at room temperature for 16 hours. Thereafter, the density of the recorded area on each sample was measured by a McBeth densitometer RD-914.

(v) Test for Evaluation of Heat Resistance

The samples were preserved for one hour at 70° C. in a dry atmosphere. Thereafter, the density of the background of each sample was measured by a McBeth densitometer RD-914.

TABLE 1

| Recording Material | Before Test | | After Test | | | |
|---|---|---|---|---|---|---|
| | | | (ii) | (iii) | (iv) | (v) |
| | A | B | A | A | A | B |
| No. 1 | 1.32 | 0.07 | 1.28 | 1.20 | 1.10 | 0.15 |
| No. 2 | 1.31 | 0.08 | 1.25 | 1.22 | 1.15 | 0.14 |
| No. 3 | 1.28 | 0.07 | 1.26 | 1.20 | 1.04 | 0.16 |
| No. 4 | 1.29 | 0.07 | 1.25 | 1.18 | 1.03 | 0.18 |
| No. 5 | 1.24 | 0.08 | 1.18 | 1.15 | 1.06 | 0.15 |
| No. 6 | 1.26 | 0.07 | 1.26 | 1.23 | 1.06 | 0.20 |
| No. 7 | 1.24 | 0.08 | 1.24 | 1.20 | 1.10 | 0.21 |
| No. 8 | 1.28 | 0.07 | 1.12 | 1.04 | 1.00 | 0.25 |
| Comp. No. 1 | 1.26 | 0.07 | 0.45 | 0.43 | 0.35 | 0.35 |
| Comp. No. 2 | 1.25 | 0.08 | 0.68 | 0.63 | 0.56 | 0.53 |
| Comp. No. 3 | 1.28 | 0.08 | 0.64 | 0.65 | 0.62 | 0.62 |
| Comp. No. 4 | 1.31 | 0.07 | 0.48 | 0.49 | 0.42 | 0.38 |
| Comp. No. 5 | 1.32 | 0.07 | 0.47 | 0.46 | 0.39 | 0.36 |

In the above table,
"A": the density of the recorded area on the sample,
"B": the density of the background on the sample,
"(ii)": the test for evaluation of oil resistance,
"(iii)": the test for evaluation of plasticizer resistance,
"(iv)": the test for evaluation of water resistance, and
"(v)": the test for evaluation of heat resistance.

The data shown in the above table demonstrate that the thermosensitive recording materials according to the present invention can yield images having high resistance to oil, plasticizer, water and heat. The images recorded from the recording materials of the present invention are thus highly reliable.

What is claimed is:

1. A thermosensitive recording material comprising:

(a) a support, and (b) a thermosensitive recording layer formed on said support, comprising a leuco dye and a color developing agent comprising a metal salt or metal complex of a compound having formula (I), which is capable of inducing color formation in said leuco dye upon application of heat thereto:

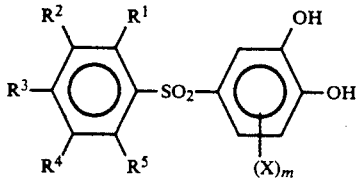

(I)

wherein X represents a halogen, an alkyl group having 1 to 10 carbon atoms, or an alkoxyl group having 1 to 10 carbon atoms; $R^1$, $R^2$, $R^3$, $R^4$ and $R^5$ independently represent hydrogen, a halogen, a hydroxyl group, an alkyl group having 1 to 10 carbon atoms, an alkoxyl group having 1 to 10 carbon atoms, an aralkyloxyl group having 7 to 20 carbon atoms, an aryloxyl group having 6 to 20 carbon atoms, an alkylthio group having 1 to 10 carbon atoms, an aralkylthio group having 6 to 20 carbon atoms or an arylthio group having 6 to 20 carbon atoms, $R^1$ and $R^2$, or $R^2$ and $R^3$ may form together with an adjacent benzene ring a naphthalene ring, a tetrahydronaphthalene ring or an indan ring and m is an integer of 1 to 4.

2. The thermosensitive recording material as claimed in claim 1, wherein X in said formula (I) represents a halogen, an alkyl group having 1 to 6 carbon atoms, or an alkoxyl group having 1 to 6 carbon atoms.

3. The thermosensitive recording material as claimed in claim 1, wherein $R^1$, $R^2$, $R^3$, $R^4$, and $R^5$ in said formula (I) independently represent hydrogen, a halogen, a hydroxyl group, an alkyl group having 1 to 6 carbon atoms, an alkoxyl group having 1 to 6 carbon atoms, an aralkyl group having 7 to 10 carbon atoms, an aryloxyl group having 6 to 10 carbon atoms, an alkylthio group having 1 to 6 carbon atoms, an aralkylthio group having 7 to 10 carbon atoms, or an arylthio group having 6 to 10 carbon atoms, and $R^1$ and $R^2$, or $R^2$ and $R^3$ may form together with an adjacent benzene ring a naphthalene ring, a tetrahydronaphthalene ring or an indan ring.

4. The thermosensitive recording material as claimed in claim 1, wherein said metal of said metal salt or said metal complex of said compound having formula (I) is selected from the group consisting of Mg, Ca, Cu, Zn, Fe, Al, Sn and Ba.

5. The thermosensitive recording material as claimed in claim 1, wherein said compound having formula (I) is a compound selected from the group consisting of 3,4-dihydroxydiphenylsulfone, 3,4-dihydroxy-4'-methyldiphenylsulfone,3,4-dihydroxy-4'-ethyldiphenylsulfone, 3,4-di-hydroxy-4'-propyldiphenylsulfone, 3,4-dihydroxy-4'-isopropyldiphenylsulfone, 3,4-dihydroxy-4'-butyldiphenylsulfone, 3,4-dihydroxy-2,4'-dimethyldiphenylsulfone, 3,4-dihydroxy-4'-chlorodiphenylsulfone, 3,4,4'-trihydroxydiphenylsulfone, 3,4-dihydroxy-4'-cyclohexyldiphenylsulfone, 3,4-dihydroxy-4'-methoxydiphenylsulfone, 3,4-dihydroxy-4'-ethoxydiphenylsulfone, 3,4-dihydroxy-4'-phenoxydiphenylsulfone, 3,4-dihydroxy-4'-benzyloxydiphenylsulfone, 3,4-dihydroxy-4'-benzyldiphenylsulfone, 3,4-dihydroxy-4'-phenethyldiphenylsulfone, 3,4-dihydroxy-4'-methylthiodiphenylsulfone, 3,4-dihydroxy-4'-ethylthiodiphenylsulfone, 3,4-dihydroxy-4'-phenylthiodiphenylsulfone, 3,4-dihydroxy-'-benzylthiodiphenylsulfone, 3,4-dihydroxyphenyl-1-naphthylsulfone, 3,4-dihydroxyphenyl-2-naphthylsulfone, 3,4-dihydroxy-2',3',5'-trimethyldiphenylsulfone, and 3,4-di-hydroxy-2',3',4',5'-tetramethyldiphenylsulfone.

6. The thermosensitive recording material as claimed in claim 1, wherein said leuco dye is a compound selected from the group consisting of triphenylmethane leuco dyes, fluoran leuco dyes, phenothiazine leuco dyes, Auramine leuco dyes, spiropyrane leuco dyes and indolinophthalide leuco dyes.

7. The thermosensitive recording material as claimed in claim 1, wherein said thermosensitive recording layer further comprises a color developing agent selected from the group consisting of phenol compounds, thiophenol compounds, thiourea compounds, organic acids and metal salts thereof.

8. The thermosensitive recording material as claimed in claim 1, wherein the amount of said metal salt or metal complex of said compound having formula (I) is 0.1 to 10 parts by weight per one part by weight of said leuco dye in said thermosensitive recording layer.

9. The thermosensitive recording material as claimed in claim 1, wherein said thermosensitive recording layer comprises (a) an undercoat layer and (b) a thermosensitive coloring layer, which layers are successively overlaid on said support, said metal salt or metal complex of said compound having formula (I) being contained in one or both of said thermosensitive coloring layer and said undercoat layer, provided that when said metal salt or metal complex of said compound having formula (I) is not contained in said thermosensitive coloring layer, an additional color developing agent capable of inducing color formation in said leuco dye upon application of heat thereto is contained in said thermosensitive coloring layer.

10. The thermosensitive recording material as claimed in claim 9, wherein when said metal salt or metal complex of said compound having formula (I) is contained in said thermosensitive coloring layer, the amount thereof is 0.1 to 10 parts by weight per one part by weight of said leuco dye contained in said thermosensitive coloring layer.

11. The thermosensitive recording material as claimed in claim 9, wherein when said metal salt or metal complex of said compound having formula (I) is contained in said undercoat layer, the amount thereof is 0.1 to 5 parts by weight per one part by weight of said leuco dye contained in said thermosensitive coloring layer.

12. The thermosensitive recording material as claimed in claim 9, wherein said additional color developing agent is selected from the group consisting of phenol compounds, thiophenol compounds, thiourea compounds, organic acids and metal salt thereof.

13. The thermosensitive recording material as claimed in claim 1, wherein said thermosensitive recording layer comprises (a) a thermosensitive coloring layer and (b) an overcoat layer, which layers are successively overlaid on said support, said metal salt or metal complex of said compound having formula (I) being contained in one or both of said thermosensitive coloring layer and said overcoat layer, provided that when said metal salt or metal complex of said compound having formula (I) is not contained in said thermosensitive coloring layer, an additional color developing agent capable of inducing color formation in said leuco dye upon application of heat thereto is contained in said thermosensitive coloring layer.

14. The thermosensitive recording material as claimed in claim 13, wherein when said metal salt or metal complex of said compound having formula (I) is contained in said thermosensitive coloring layer, the amount thereof is 0.1 to 10 parts by weight per one part by weight of said leuco dye contained in said thermosensitive coloring layer.

15. The thermosensitive recording material as claimed in claim 13, wherein when said metal salt or metal complex of said compound having formula (I) is contained in said overcoat layer, the amount thereof is 0.1 to 5 parts by weight per one part by weight of said leuco dye contained in said thermosensitive coloring layer.

16. The thermosensitive recording material as claimed in claim 13, wherein said additional color developing agent is selected from the group consisting of phenol compounds, thiophenol compounds, thiourea compounds, organic acids and metal salt thereof.

17. The thermosensitive recording material as claimed in claim 1, wherein said thermosensitive recording layer comprises (a) an undercoat layer, (b) a thermosensitive coloring layer and (c) an overcoat layer, which layers are successively overlaid on said support, said metal salt or metal complex of said compound having formula (I) being contained in at least one of said undercoat layer, said thermosensitive coloring layer and said overcoat layer, provided that when said metal salt or metal complex of said compound having formula (I) is not contained in said thermosensitive coloring layer, an additional color developing agent capable of inducing color formation in said leuco dye upon application of heat thereto is contained in said thermosensitive coloring layer.

18. The thermosensitive recording material as claimed in claim 17, wherein when said metal salt or metal complex of said compound having formula (I) is contained in said thermosensitive coloring layer, the amount thereof is 0.1 to 10 parts by weight per one part by weight cf said leuco dye contained in said thermosensitive coloring layer.

19. The thermosensitive recording material as claimed in claim 17, wherein when said metal salt or metal complex of said compound having formula (I) is contained in said undercoat layer and/or said overcoat layer, the amount thereof in each layer is 0.1 to 5 parts by weight per one part by weight of said leuco dye contained in said thermosensitive coloring layer.

20. The thermosensitive recording material as claimed in claim 17, wherein said additional color developing agent is selected from the group consisting of phenol compounds, thiophenol compounds, thiourea compounds, organic acids and metal salt thereof.

* * * * *

UNITED STATES PATENT AND TRADEMARK OFFICE

CERTIFICATE OF CORRECTION

PATENT NO. : 5,043,313

DATED : AUGUST 27, 1991

INVENTOR(S) : YASUTOMO MORI ET AL

It is certified that error appears in the above-identified patent and that said Letters Patent is hereby corrected as shown below:

Column 1, line 26, page 2, "advatageous" should read --advantageous--.

Column 1, line 61, page 2, "2,4-bis(4β-hydroxybenzoylox" should read --2,4-bis(4-β-p-hydroxybenzoylox--.

Column 5, line 65, page 4, "1,3-bis4-hydroxyphenylthio)-" should read --1,3-bis(4-hydroxyphenylthio)--.

Column 6, line 24, page 4, "1,2-bis-(phenoxy)ethane", should read --1,2-bis(phenoxy)ethane--.

Column 6, line 51, page 4, "sytrene" should read --styrene--.

Column 13, lines 34 and 35, page 8, "indan ring and m is an integer of 1 to 4" should read --indan ring; and m is an integer of 1 to 4--.

Signed and Sealed this

Eighth Day of June, 1993

*Attest:*

*Attesting Officer*

Michael K. Kirk

MICHAEL K. KIRK

*Acting Commissioner of Patents and Trademarks*